United States Patent [19]

Eichler

[11] Patent Number: 4,997,112

[45] Date of Patent: Mar. 5, 1991

[54] DEVICE

[75] Inventor: Klaus Eichler, Buehl, Fed. Rep. of Germany

[73] Assignee: Langner & Fischer GmbH, Fed. Rep. of Germany

[21] Appl. No.: 385,549

[22] Filed: Jul. 26, 1989

[30] Foreign Application Priority Data

Jul. 28, 1988 [GB] United Kingdom ..... 8818045

[51] Int. Cl.[5] ..... B67D 3/00

[52] U.S. Cl. ..... 222/530; 222/505

[58] Field of Search ..... 222/530, 527, 526, 505, 222/519, 525, 522

[56] References Cited

U.S. PATENT DOCUMENTS 3,253,728 5/1966 de Putron ..... 222/525

4,726,491 2/1988 Moon ..... 222/530

*Primary Examiner*—H. Grant Skaggs

*Assistant Examiner*—Kenneth Noland

*Attorney, Agent, or Firm*—Jacobs & Jacobs

[57] ABSTRACT

A dispenser has an outlet nozzle which is reversibly movable by rotation of a control cap from a first extended position, in which adhesives is dispensed as a series of fine spots, to a second retracted position in which adhesive is dispensed as a film using the flat upper surface of the control cap as a spreading tool. The base of the nozzle is joined to the walls of the dispenser by a flexible membrane. The control cap is provided with a centrally located hole, in the flat upper surface, through which the nozzle can protrude, and an internal coaxial sleeve which surrounds the nozzle. The latter is provided with a locating stud which cooperates with a screw groove in the inner surface of the sleeve so that manual rotation of the control cap causes the stud to travel along the groove, thereby causing the nozzle to move between the first and second positions.

9 Claims, 2 Drawing Sheets

DEVICE

This invention relates to dispensers, in particular dispensers suitable for dispensing fluent liquid adhesives.

Adhesives are often applied to the substrate either as a fine line or as a series of spots, from a pointed applicator nozzle, for small scale delicate work, or as a film covering a large area, with the aid of some form of spreading tool. A dispenser which can operate in both modes is useful, as it avoids the need to have two separate dispensers.

GB 1 539 087 (Lingner+Fischer GmbH) discloses a dispenser which is provided with a control cap which is rotatable about the longitudinal axis of the dispenser, and with an elongate static cylindrical outlet nozzle which may project through a hole centrally located in the surface of the control cap. The control cap is equipped with a locating stud which projects into and cooperates with an inclined groove provided on the dispenser body. Rotation of the cap causes the stud to move along the inclined groove. In doing so, the control cap moves spirally between a first position in which the nozzle is exposed, so that it can be used to dispense adhesive as, for instance, a series of drops, and a second position in which the end of the nozzle is just below the surface of the control cap, so that the surface thereof can be used as a spreading tool.

A dispenser is also available commercially (used by Henkel for their product 'Pritt Multi-Glue'; 'Pritt' is a Trade Mark) which is a variant on the aforementioned dispenser in that the groove on the dispenser body is longitudinal, rather than inclined, so that the control cap moves linearly, rather than spirally, between the two positions.

The present invention provides a dispenser also capable of dispensing adhesives as a film or a series of fine spots, which has an outlet nozzle which is caused to move linearly relative to the dispenser body by the rotation of a control cap.

According to the present invention, there is provided a dispenser suitable for dispensing fluent liquid adhesives comprising:

a squeezable reservoir body, an outlet for which is provided by an elongate cylindrical nozzle, the base of the nozzle being attached via a flexible membrane to the walls of the reservoir body; and a control cap which has a generally flat upper surface containing a central hole through which the nozzle can protrude, in a close-fitting manner, and from the underside of which surface extends internally a coaxial sleeve, surrounding the hole and accommodating the nozzle, the control cap being mounted on the reservoir body and being manually rotatable thereon about the longitudinal axis of the nozzle;

the nozzle being equipped with a locating stud which cooperates with a screw groove in the inner surface of the sleeve in such a manner that manual rotation of the control cap in one direction about the longitudinal axis of the nozzle causes the stud to travel along the groove towards the end of the groove remote from the flat upper surface of the control cap, thereby retracting the nozzle into the dispenser, until the tip of the nozzle does not project beyond the flat upper surface, and rotation in the opposite direction causes the stud to travel along the groove towards the end of the groove nearer to the flat upper surface, thereby causing the tip of the nozzle to project beyond the flat upper surface.

When the nozzle is in the retracted position, such that the tip does not project beyond the flat upper surface of the control cap, the surface acts as a spreading tool so that adhesive emerging from the nozzle can be spread as a film. In contrast, when the nozzle is in an extended position, such that the nozzle projects through the flat upper surface of the control cap, adhesive can be dispensed from the tip as a fine line or as a series of spots. The membrane joining the base of the nozzle to the walls of the reservoir body allows the nozzle to move reversibly between the retracted and extended positions, whilst maintaining an effective cover for the reservoir body.

It will be appreciated that the plane of the generally flat upper surface of the control cap can either be substantially perpendicular to the longitudinal axis of the dispenser or at an angle inclined thereto. Preferably, the flat upper surface is perpendicular to the longitudinal axis.

Preferably, the dispenser comprises a nozzle unit and a reservoir unit, the nozzle unit including the nozzle and the membrane and having walls engaging with the reservoir unit and joined by the membrane to the base of the nozzle, the nozzle unit being removable from and replaceable on the reservoir unit. Such an arrangement permits the easier filling and/or replacement of the reservoir unit.

Preferably the nozzle is provided with two diametrically opposed locating studs and the inner surface of the sleeve with two screw grooves.

Preferably, the position of the locating stud on the nozzle and the pitch and length of the screw groove are such that when the tip of the nozzle is just below the flat upper surface of the control cap, the stud is towards the end of the screw groove remote from the flat upper surface of the control cap and when the tip of the nozzle is furtherest removed from the flat upper surface of the control cap, the stud is towards the end of the screw groove nearer to the flat upper surface.

Preferably, the dispenser is equipped with a removable and replaceable closure plug or cap to seal the nozzle opening, thereby preventing solvent from the fluent adhesive material escaping. The plug or cap may be tethered to the dispenser by a flexible tie.

The plug or cap may be provided with hook means, to allow the dispenser to be hung from a hook or rail, for storage or display purposes.

Advantageously, the plug or cap is removable from the dispenser by rotation of the control cap.

One form of a dispenser according to the invention will now be described by way of example only with reference to the accompanying drawings in which.

Figure 1:
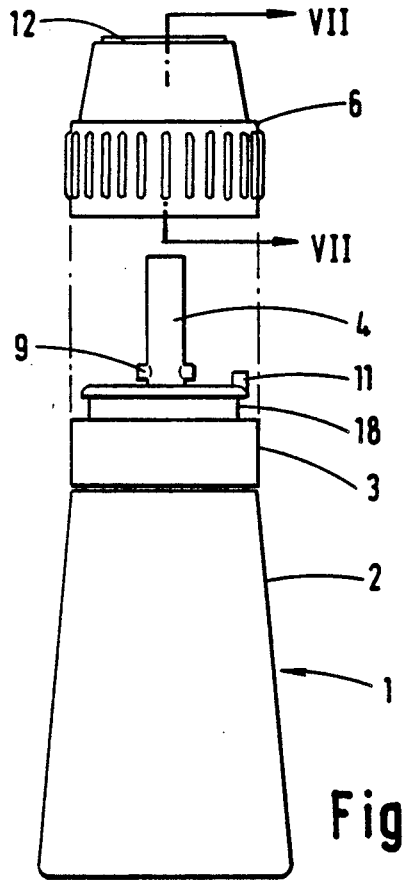
FIG. 1 shows a partially exploded front view of the dispenser, with the nozzle fully retracted.
Figure 2:
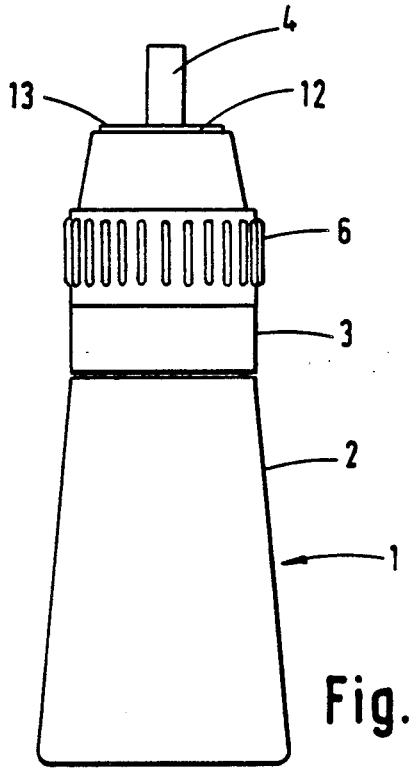
FIG. 2 shows a front view of the dispenser, with the nozzle fully extended.

The dispenser 1 has a squeezable reservoir unit 2, a nozzle unit 3 comprising an elongate cylindrical nozzle 4 joined via a membrane 5 to walls 8, and a control cap 6.

The reservoir unit 2, for holding fluent adhesive material, is made of a suitable plastics material and is secured via screw threads 7 to the walls 8 of the nozzle unit 3, the reservoir unit 2 being generally cylindrical in the region of the screw threads 7 and therebelow of increasing oval cross section.

The elongate cylindrical nozzle 4 which forms part of the nozzle unit 3 is coaxial with the dispenser 1, the base of the nozzle 4 being joined to the walls 8 of the nozzle unit 3 by the membrane 5, thereby also providing an inner cover for the reservoir unit 2. The membrane 5 is in the form of a flexible skirt and is made of a suitable plastics material, for example polypropylene. Two diametrically opposed locating studs 9 are provided on the nozzle 4. An opening 10 is present in the tip of the nozzle 4, to serve as an outlet for adhesive from the reservoir unit 2. A stop-stud 11 is provided on the upper rim of the walls 8 of the nozzle unit 3. Teeth (not shown) are provided on the lower internal edge of the walls 8 of the nozzle unit 3, to engage with complementary teeth (also not shown) provided on the shoulder of the reservoir unit 2, below the screw threads 7, to prevent undesired rotation of the nozzle unit 3 with respect to the reservoir unit 2, when the dispenser is assembled.

Figure 3:
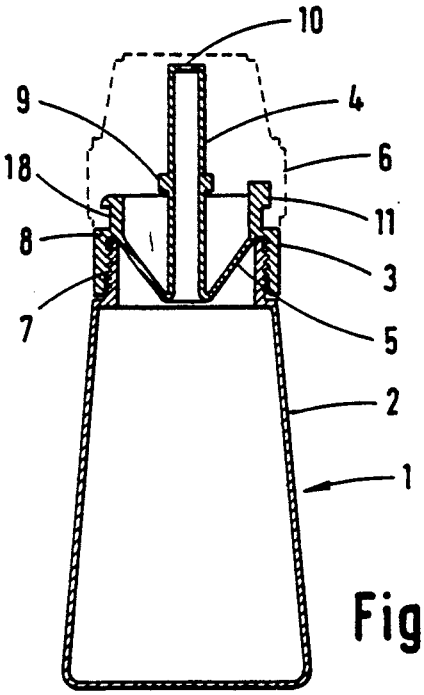
FIG. 3 shows a longitudinal cross-sectional view of the dispenser taken in the plane of the paper of the view shown in FIG. 1.
Figure 7:
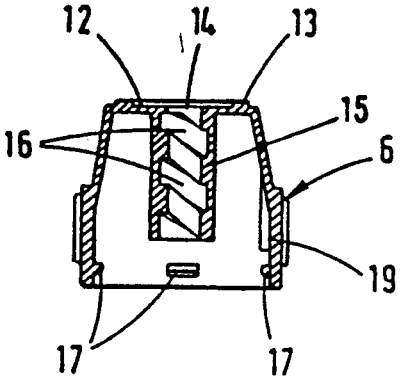
FIG. 7 shows a cross-sectional view through the control cap, along the line VII—VII of FIG. 1.
Figure 8:
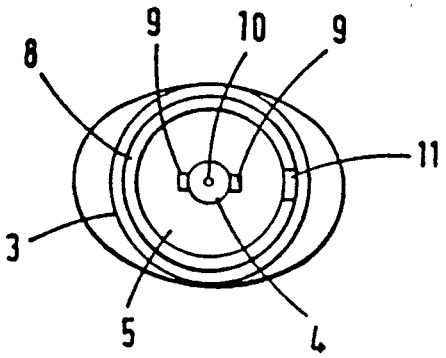
FIG. 8 shows a top plan view of the dispenser, with the control cap removed.

Referring to FIG. 7, the control cap 6 is provided with a flat upper surface 12, the effective level of which is raised by the inclusion of a projecting annulus 13. In the center of the surface 12 is located a hole 14, through which the nozzle 4 can protrude in a close-fitting manner. Extending coaxially with the dispenser, internally from the upper surface 12 of the control cap 6, and surrounding the hole 14, is a sleeve 15. This is provided with two internal screw grooves 16, each of which, when the nozzle 4 is inserted, snugly accommodates a complementary locating stud 9, the stud 9 projecting therein and being able to move therealong. The locating studs 9 are positioned on the nozzle 4 such that when the tip of the nozzle 4 is slightly below the effective level of the flat upper surface 12 of the control cap 6, as shown in FIG. 3, the studs 9 are located towards the lower ends of the screw grooves 16. The extremities of the stud movement correspond to the nozzle positions of FIGS. 3 and 4. The control cap 6 fits onto the nozzle unit 3 by a snap-fit engagement of circumferential lugs 17 with a complementary exterior circumferential recess 18 provided on the nozzle unit 3, thereby allowing manual rotation of the control cap 6 with respect to the nozzle unit 3.

Two stop-lugs 19 (only one of which is shown) are located on the inner surface of the control cap 6, to engage the stop-stud 11 thereby restricting the rotational movement of the control cap 6 relative, to the nozzle unit 3 to circa 310°.

The dispenser 1 is assembled prior to use by first placing the control cap 6 over the end of the nozzle 4 so that the sleeve 15 slides over the nozzle 4 until the locating studs 9 engage in the ends of the screw grooves 16 which are remote from the upper surface 12 of the control cap 6; the control cap 6 then being pushed onto the nozzle unit 3 so that the circumferential lugs 17 engage the complementary recess 18. The nozzle unit 3 is screwed onto the reservoir unit 2, the unit 2 having previously been filled with fluent adhesive material.

Figure 4:
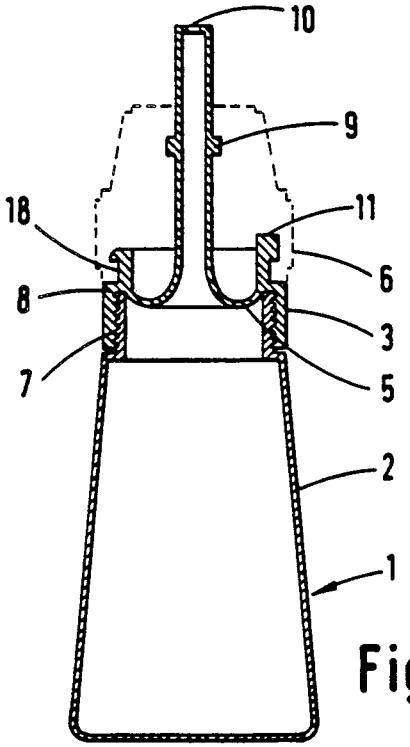
FIG. 4 shows a similar view to FIG. 3, except that the nozzle is fully extended.

Lateral rotation of the control cap 6 in one direction will cause the locating studs 9 to move along the screw grooves 16 towards the upper surface 12 of the control cap 6, thereby projecting the nozzle 4 beyond the surface 12 until the position shown in FIG. 4 is established, further rotation of the control cap 6 being then prevented by engagement of one of the stop-lugs 19 with the stop-stud 11.

Lateral rotation of the control cap 6 in the reverse direction will cause the studs 9 to move along the screw grooves 16 towards the ends remote from the upper surface 12, until the position shown in FIG. 3 is established, further rotation of the control cap 6 being then prevented by engagement of the second stop-lug 19 with the stop-stud 11.

It will be appreciated that the flexibility of the membrane 5, the location of the studs 9 on the nozzle 4 and the pitch and length of the screw grooves 16 are such as to permit the reversible movement of the nozzle 4 effected by rotation of the control cap 6 hereinbefore described.

When the nozzle 4 is in the position shown in FIG. 3, a spreading mode of adhesive application can be effected by tilting or inverting the dispenser and squeezing the reservoir unit 2, causing adhesive to flow along the nozzle 4 through the opening 10 and onto the work area across which the adhesive can then be spread by the projecting annulus 13. Intermittant squeezing of the reservoir unit 2, as the annulus 13 is rubbed across the work area, delivers more of the adhesive material and the spreading operation continues.

In contrast, when the nozzle 4 is in the position shown in FIG. 4, the tip of the nozzle 4 is away from the flat surface 12 and the former can then be used to deliver small quantities of the adhesive material to the work piece as a series of spots or in fine lines.

Figure 5:
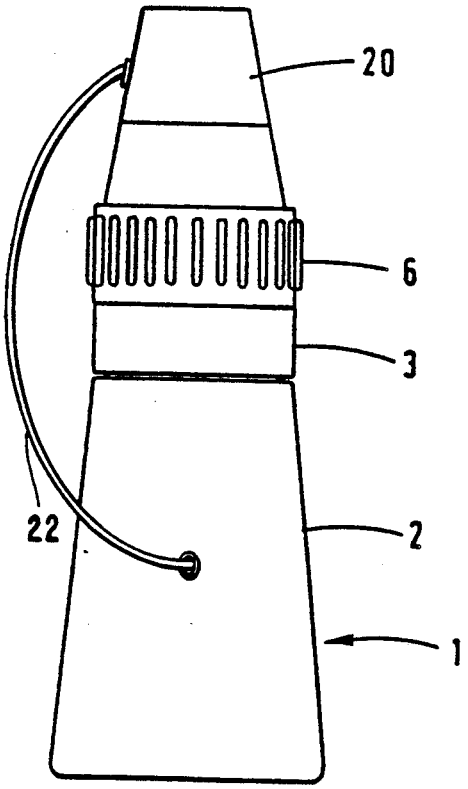
FIG. 5 shows a front view of the dispenser, with the nozzle fully extended, with the addition of a cap for sealing the nozzle.
Figure 6:
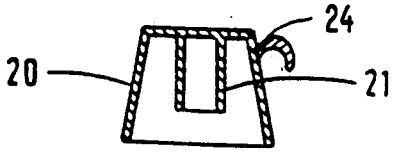
FIG. 6 shows a cross-sectional view of the sealing cap shown in FIG. 5.

Referring now to FIGS. 5 and 6, a hollow sealing cap 20 is mounted on the end of the nozzle 4, when the nozzle 4 is projecting beyond the flat upper surface 12. The sealing cap 20 is provided with a centrally located coaxial sleeve 21 which depends internally from the closed end of the cap 20, the sleeve 21 accommodating, in a push-fit manner, the end of the nozzle 4, to provide a solvent-tight seal. The skirt of the cap 20 fits loosely around the projecting annulus 13. In use, when the sealing cap 20 is in place, as shown in FIG. 5, rotation of the control cap 6 causes gradual retraction of the nozzle 4 from the sleeve 21, until the nozzle 4 is fully retracted, at which point, the cap 20 falls away. Alternatively, the cap 20 is removed by simply pulling it away from the remainder of the dispenser.

A longitudinally ribbed external surface is provided to the cylindrical surface of the control cap 6, to permit a good finger grip to be achieved, so that the cap 6 can be easily rotated.

I claim:

1. A dispenser suitable for dispensing fluent liquid adhesives comprising:

(i) a squeezable reservoir body;

(ii) an elongate cylindrical nozzle to provide an outlet for said reservoir body;

(iii) a flexible membrane to join the base of said nozzle to the walls of said reservoir body;

(iv) a control cap which has a generally flat upper surface, and is mounted on said reservoir body and is manually rotatable thereon about the longitudinal axis of said nozzle;

(v) a central hole in said flat upper surface, through which said nozzle can protrude, in a close-fitting manner;

(vi) a coaxial sleeve extending internally from the underside of said flat surface, surrounding said hole and accommodating said nozzle;

(vii) a screw groove provided in the inner surface of said sleeve; and (viii) a locating stud provided on said nozzle, to cooperate with said screw groove, in such a manner that manual rotation of said control cap in one direction about said longitudinal axis of said nozzle causes said stud to travel along said groove towards the end of said groove remote from said flat upper surface of said control cap, thereby retracting said nozzle into said dispenser, until the tip of said nozzle is disposed within the control cap and below said flat upper surface, and rotation in the opposite direction causes said stud to travel along said groove towards the end of said groove nearer to said flat upper surface, thereby causing said tip of said nozzle to project beyond said flat upper surface.

2. A dispenser as claimed in claim 1 which comprises a reservoir unit and a nozzle unit, which nozzle unit includes said nozzle and said membrane and which has walls engaging with said reservoir unit and joined by said membrane to said base of said nozzle, said nozzle unit being removable from and replaceable on said reservoir unit.

3. A dispenser as claimed in claim 1 in which said nozzle is provided with two diametrically opposed studs and said inner surface of said sleeve is provided with two screw grooves, each of which said grooves accommodates a said stud.

4. A dispenser as claimed in claim 1 in which the position of said locating stud on said nozzle and the pitch and length of said screw groove are such that when said tip of said nozzle is just below said flat upper surface of said control cap, said stud is towards the end of said screw groove remote from said flat upper surface of said control cap and when said tip of said nozzle is furtherest removed from said flat upper surface of said control cap, said stud is towards said end of the screw groove nearer to said flat upper surface.

5. A dispenser as claimed in claim 1 which is equipped with a removable and replaceable closure plug or cap to seal said nozzle opening.

6. A dispenser as claimed in claim 5 in which said plug or cap is tethered to the dispenser by a flexible tie.

7. A dispenser as claimed in claim 5 in which said plug or cap is provided with hook means.

8. A dispenser as claimed claim 5 in which said plug or cap is removable from the dispenser by rotation of said control cap.

9. A dispenser as claimed in claim 1 in which said flat upper surface of the control cap is substantially perpendicular to the longitudinal axis of the dispenser.

* * * * *